US008478509B1

(12) United States Patent
Kirkpatrick et al.

(10) Patent No.: US 8,478,509 B1
(45) Date of Patent: Jul. 2, 2013

(54) METHOD AND APPARATUS FOR VARYING THE DURATION OF A FUEL INJECTOR CYCLE PULSE LENGTH

(76) Inventors: William E. Kirkpatrick, Bozeman, MT (US); Harley Leach, Bozeman, MT (US)

( * ) Notice: Subject to any disclaimer, the term of this patent is extended or adjusted under 35 U.S.C. 154(b) by 546 days.

(21) Appl. No.: 12/851,891

(22) Filed: Aug. 6, 2010

Related U.S. Application Data

(60) Provisional application No. 61/232,264, filed on Aug. 7, 2009.

(51) Int. Cl.
*F02M 51/00* (2006.01)

(52) U.S. Cl.
USPC ..... 701/104; 701/105; 701/107; 123/479; 123/480; 123/490; 73/114.49

(58) Field of Classification Search
USPC ..... 701/103, 104, 105, 107; 123/479, 123/480, 490; 73/114.49
See application file for complete search history.

(56) References Cited

U.S. PATENT DOCUMENTS

| | | | | |
|---|---|---|---|---|
| 4,209,829 | A | 6/1980 | Leichle | |
| 4,320,729 | A * | 3/1982 | Sawada et al. | 123/406.16 |
| 4,355,619 | A | 10/1982 | Wilkinson | |
| 4,370,962 | A * | 2/1983 | Hosaka | 123/406.13 |
| 4,499,878 | A | 2/1985 | Igashira et al. | |
| 4,531,495 | A * | 7/1985 | Yamato et al. | 123/479 |
| 4,649,886 | A | 3/1987 | Igashira et al. | |
| 5,153,835 | A * | 10/1992 | Hashimoto et al. | 701/114 |
| 5,515,830 | A | 5/1996 | Arakowa | |
| 5,941,216 | A | 8/1999 | Arakowa | |
| 5,954,030 | A | 9/1999 | Shurman et al. | |
| 6,005,763 | A | 12/1999 | North | |
| 6,102,008 | A * | 8/2000 | Maeda et al. | 123/490 |
| 6,286,492 | B1 | 9/2001 | Kanno | |
| 6,923,163 | B2 | 8/2005 | Yamazaki | |
| 7,000,599 | B2 | 2/2006 | Kirkpatrick | |
| 7,124,742 | B1 * | 10/2006 | Kirkpatrick | 123/490 |
| 7,177,759 | B2 * | 2/2007 | Nakamura | 701/114 |
| 7,527,040 | B2 * | 5/2009 | Couch | 123/490 |
| 2005/0111160 | A1 | 5/2005 | Faggioli et al. | |
| 2006/0178803 | A1 * | 8/2006 | Nakamura | 701/114 |

* cited by examiner

*Primary Examiner* — Erik Solis
(74) *Attorney, Agent, or Firm* — MacMillan, Sobanski & Todd, LLC

(57) ABSTRACT

A voltage spike generated by the collapse of the magnetic field in a fuel injector coil is stored in a capacitor and sent to an engine control unit at a correct time regardless of when the magnetic field in the injector coil actually collapses.

11 Claims, 3 Drawing Sheets

METHOD AND APPARATUS FOR VARYING THE DURATION OF A FUEL INJECTOR CYCLE PULSE LENGTH

CROSS-REFERENCE TO RELATED APPLICATIONS

This application claims the benefit of U.S. Provisional Application No. 61/232,264, filed Aug. 7, 2009, the disclosure of which is incorporated herein by reference.

BACKGROUND OF THE INVENTION

This invention relates in general to circuits for controlling fuel injectors for vehicle engines and in particular to a supplemental fuel injector control circuit for varying the duration of a fuel injector pulse length.

Fuel injection provides carefully controlled metering of fuel supplied to a vehicle engine. The careful control of fuel supply enhances engine performance and mileage while reducing harmful emissions. Referring now to the drawings, there is shown in FIG. 1 a typical known circuit for controlling a fuel injector valve. The circuit includes an Engine Control Unit (ECU) 10 having a voltage control port 12 that is connected to a first end of a fuel injector coil 14. A second end of the injector coil 14 is connected to a voltage supply V+, which for a vehicle engine, is typically a 12 volt battery. The ECU 10 includes an electronic switch for controlling the fuel injector, which in FIG. 1 is a Metal Oxide Semiconductor Field Effect Transistor (MOSFET) 16. The first end of the injector coil 14 is connected to the drain terminal of the MOSFET 16 while the MOSFET source terminal is connected to ground. The gate terminal of MOSFET 16 is connected to a control port 18 of an ECU microprocessor 19 and the MOSFET source terminal is connected through a fault detection circuit 20 to a feedback port 22 on the ECU microprocessor. When the fuel injector control MOSFET 16 is placed into a conducting state, the voltage V+ is applied across the fuel injector coil 14 and a current flows through the coil causing a magnetic field that opens the fuel injector to supply fuel to an associated engine cylinder. Likewise, when the MOSFET 16 is placed into a non-conducting state, the voltage V+ is removed from across the fuel injector coil 16, the current flowing through the coil ceases and the fuel injector closes, interrupting the supply of fuel to the associated engine cylinder.

ECUs are becoming increasingly sophisticated, providing advanced diagnostic capabilities to detect problems within the system. The ECU microprocessor 19 monitors the fuel injection cycle to determine if the injector and injector controller are operating properly. As described above, when the fuel injector control MOSFET 16 is placed into a non-conducting state, the magnetic field in the fuel injector coil 14 collapses, causing a voltage spike that is greater than the supply voltage and that is applied to the fault detection circuit 20. The fault detection circuit 20 is operable to change the condition of the microprocessor feedback port 22 upon detection of a voltage spike. Logic within the ECU microprocessor is selectively operative to set an error flag in response to the changed condition on the microprocessor feedback port 22. Typically, an error flag is set if a voltage spike is detected when the injector is supposed to be off or if the voltage spike does not occur within an expected time period following the injector being turned off. Upon detection of a fault, a warning signal, such as the illumination of a warning light upon the vehicle dashboard, is generated to inform the vehicle operator that the engine is not operating properly. Additionally, a fault condition may place the ECU into a "limp home" mode and save an error code in memory for a later diagnostic.

The operation of the fault detection circuit 20 is illustrated in FIG. 2 where the voltage appearing at the drain terminal, $V_{DRAIN}$, of MOSFET 16 is plotted as a function of time. Before time $t_1$, the MOSFET 16 is in a non-conducting state and the voltage V+ appears at its drain terminal. At time $t_1$, the MOSFET 16 is placed in a conducting state and the voltage at its drain terminal goes to zero. At a later time, $t_2$, the MOSFET 16 is returned to a non-conducting state and the voltage V+ again appears at its drain terminal. Removal of the voltage from across the injector coil 14 causes the magnetic field within the coil to collapse at time $t_2$, causing the voltage spike labeled 24 in FIG. 2. The time interval between $t_1$ and $t_2$ is labeled $\Delta T$ and represents the duration of the time that the fuel injector is open. The voltage spike 24 is detected by the fault detection circuit 20 which is operative to change the condition at the ECU microprocessor feedback port 22. As described above, logic within the ECU microprocessor 19 then determines whether the ECU 10 and/or the fuel injector are operating properly. While only one fuel injector coil 14 is shown in FIG. 1, it will be appreciated that a similar circuit is provided for each of the vehicle engine cylinders.

When modifications are made to a vehicle engine, such as replacing the exhaust system, the stock ECU 10 no longer provides the correct fuel amount across the engine's operating range. A resulting lean fuel/air mixture may be corrected by holding the fuel injector open for a longer period of time, i.e., by increasing the length of the voltage pulse applied to the fuel injector coil 14. Similarly, a resulting rich fuel/air mixture may be corrected by holding the fuel injector open for a shorter period of time, i.e., by decreasing the length of the voltage pulse applied to the fuel injector coil 14. However, as described above, the injector coil 14 is monitored by the ECU 10 and the ECU will erroneously conclude that the ECU injector closed either early or late and will generate an engine error code, indicating a fault in the injection circuit. Additionally, engine tuners may desire to change the timing of when the injector voltage pulse occurs relative to when the cylinder intake valve opens. Such changes may also trigger false error codes. Accordingly it would be desirable to provide a circuit that would allow varying the fuel injector pulse length and/or timing without triggering ECU error messages.

SUMMARY OF THE INVENTION

This invention relates to a supplemental fuel injector control circuit for varying the duration of a fuel injector pulse length.

The present invention contemplates a supplemental fuel injector control circuit that includes an electronic switch adapted to be connected to a fuel injector coil, the electronic switch being operable to control the flow of an electric current through the fuel injector coil. The control circuit also includes a capacitor adapted to be connected to the fuel injector coil and an electronic switching circuit that has an input port connected to the capacitor and an output port adapted to be connected to a voltage control port on an engine control unit. The present invention further contemplates a microprocessor connected to the electronic switch and the engine control unit voltage control port, the microprocessor operative upon a change in a condition at the engine control unit voltage control port to supply a voltage having a modified pulse length to the fuel injector coil. Additionally, the electronic switching circuit is operative upon a further change in a condition at the engine control unit voltage control port to cause the electronic switching circuit to supply energy stored within the capacitor to the engine control unit voltage control port to simulate the duration of a normal fuel injector control pulse.

The present invention also contemplates the method of operation of the control circuit described above.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
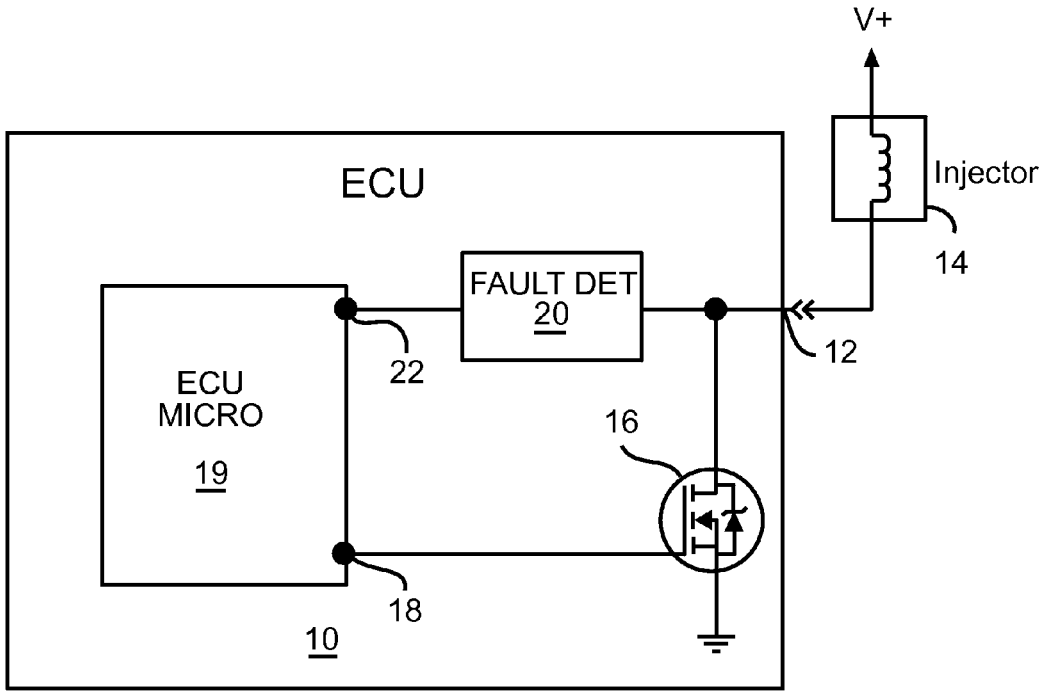
FIG. 1 (Prior Art)
FIG. 1 is a schematic diagram of a prior art fuel injector control circuit.
Figure 3:
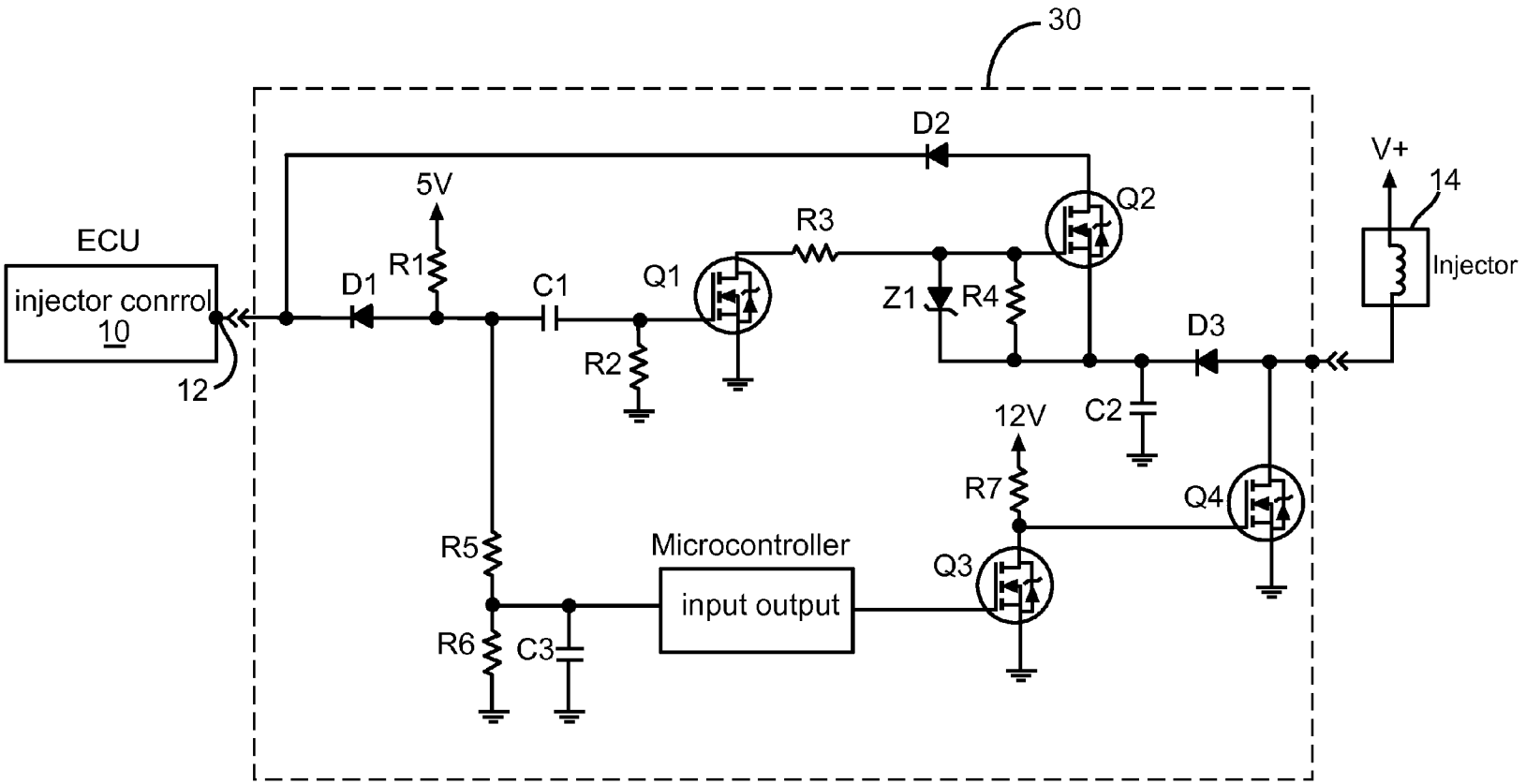
FIG. 3 is a schematic diagram of a supplemental fuel injector control circuit that is in accordance with the present invention.

Referring again to the drawings, there is illustrated in FIG. 3 a supplemental fuel injector control circuit 30 that is in accordance with the present invention. Components shown in FIG. 3 that are similar to components shown in FIG. 1 have the same numerical identifiers. As shown in FIG. 3, the supplemental fuel injector control circuit 30 is inserted between the ECU voltage output port 12 and the first end of the fuel injector coil 14. As will be described below, the control circuit 30 is operable to provide a feedback voltage spike to the control port 12. Accordingly, a voltage feedback port for the engine ECU 10 is not needed.

The present invention contemplates allowing the injector pulse width, or duty cycle, to be modified without the ECU 10 sensing the modification. Thus, modification of the injector duty cycle will not cause generation of an error signal. The invention contemplates that the energy in the voltage spike generated by the collapse of the magnetic field in the injector coil is stored in a capacitor C2. The stored energy is then sent to the ECU 10 when the ECU control port 12 transitions to an off condition, thus providing a virtual voltage spike at the expected time regardless of when the actual voltage spike was received. The pulse from the previous injector opening is used to supply the energy stored in the capacitor. The supplemental control circuit also includes an electronic switch, such as a FET, for supplying a voltage pulse to the injector coil that has the desired duration and that may differ from that supplied by the ECU 10.

The operation of the supplemental control circuit will now be described. As described above, the ECU injector control output is typically a MOSFET or a Bipolar transistor. For the injector to be turned off, the transistor drain or collector is open. Under this condition, D1 is reverse biased leaving its cathode pulled to 5V through R1. R5 & R6 form a voltage divider to drop the 5V signal to the 3.3V required by the microcontroller. When the ECU turns the injector on, the injector control output 12 is pulled to nearly zero volts, forward biasing D1 and dropping its cathode voltage to the forward voltage drop of the diode, which is approximately 0.6-1V. The microcontroller within the supplemental control circuit measures the resulting pulse and, depending on the user parameters and engine conditions, outputs a pulse unchanged, shortened or lengthened to Q3 which turns the injector on through Q4.

When Q4 turns off, the magnetic field created by the injector coil collapses, causing a voltage spike. D3 becomes forward biased causing C2 to become charged over a several pulses. The maximum voltage is limited to a voltage determined by Q4's specifications.

While the ECU's injector control output is on (low voltage), C1 is discharged through R1 & R2 to D1's forward voltage drop. When the injector control output 12 is turned off the abrupt voltage rise turns on Q1. Q1 remains on until Q1's gate voltage drops below its threshold voltage due to C1 charging through R1 and R2. Q2's (P-channel) gate is pulled low through R3 and Q1, turning on Q2 and passing the voltage present on C2 to the ECU injector control port 12. The ECU interprets the received voltage spike as if it were created by the injector itself preventing the ECU from generating an injector fault condition. Additionally, should the injector cease to function properly, it will not generate a voltage spike and so will not charge the capacitor C2. The ECU will then not sense the expected discharge spike and will set an error code as usual.

Figure 2:
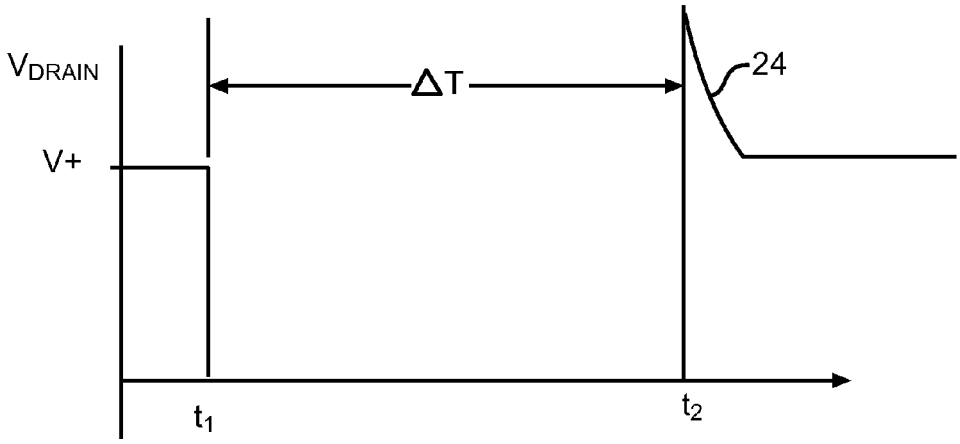
FIG. 2 (Prior Art)
FIG. 2 illustrates the voltage appearing at the drain terminal of the fuel injector control MOSFET shown in FIG. 1.
Figure 4:
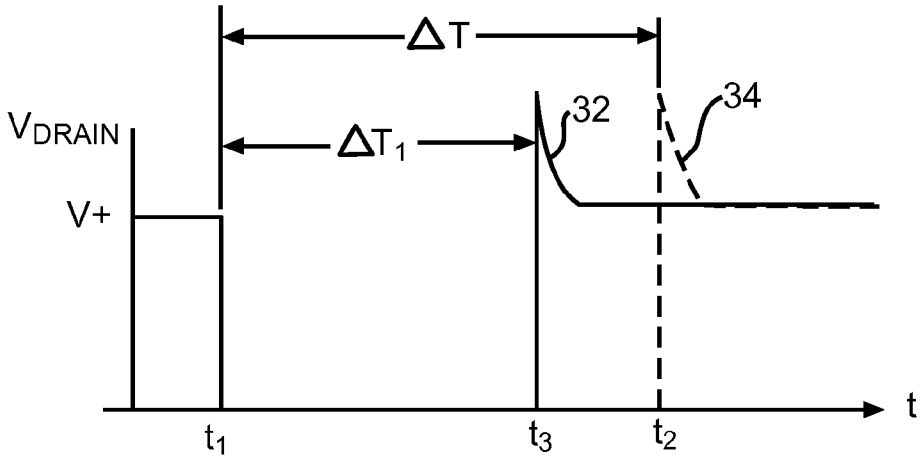
FIG. 4 illustrates the voltage appearing at the drain terminal of the fuel injector control MOSFET shown in FIG. 3 for a shortened fuel injector cycle.
Figure 5:
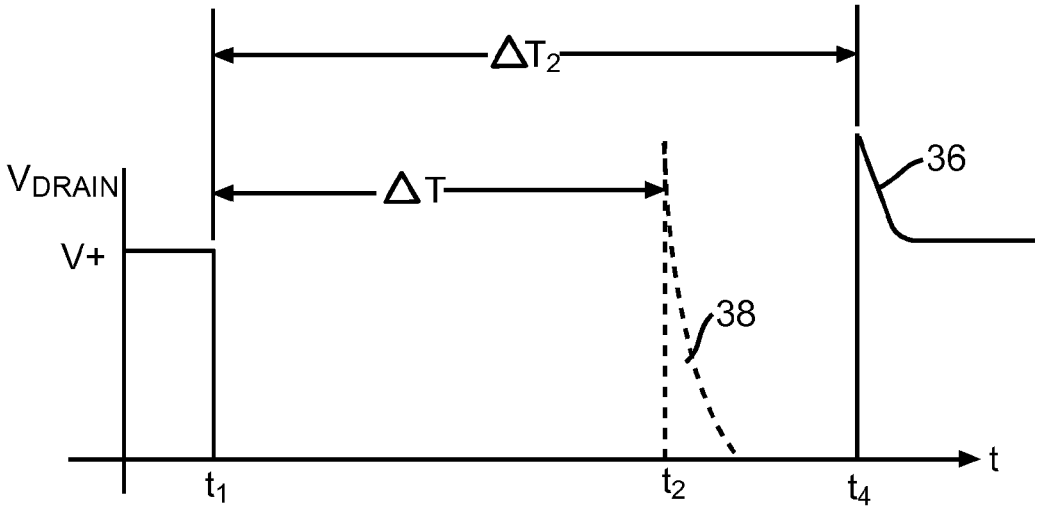
FIG. 5 illustrates the voltage appearing at the drain terminal of the fuel injector control MOSFET shown in FIG. 3 for a lengthened fuel injector cycle.

The operation of the supplemental control circuit is illustrated by FIGS. 4 and 5, where items that are similar to items shown in FIG. 2 have the same numerical identifiers. FIG. 4 illustrates operation of the supplemental control circuit 30 for a shortened duration voltage pulse 32 applied to the fuel injector coil 14. As before, the voltage at the drain terminal of the fuel injector control MOSFET Q4 goes to zero beginning at $t_1$, when the ECU control port 12 goes low and Q4 is changed to a conducting state. At $t_3$, which occurs before $t_2$, Q4 changes to a non-conducting state which removes the voltage from across the coil 14 and causes the voltage spike labeled 32 in FIG. 4. The time interval between $t_1$ and $t_3$ is labeled $\Delta T_1$ and represents the reduced length of the voltage pulse applied across the fuel injector coil. The energy within the voltage spike 32 is used to charge the capacitor C2 within the supplemental control circuit 30. Accordingly, the ECU does not register that the fuel injector has been opened and does not generate an error signal. At $t_2$, the ECU voltage control port 12 goes high and the supplemental control circuit 30 uses the energy stored in the capacitor C2 to generate a virtual voltage spike 34 that is applied to the ECU injector control port 12. Because the time interval between the initial voltage application and receipt of the virtual voltage spike 34 remains $\Delta T$, the ECU does not detect the reduced length of the voltage pulse applied across the fuel injector coil.

Referring now to FIG. 5, there is illustrated operation of the supplemental control circuit 30 for an increased duration voltage pulse 36 applied to the fuel injector coil 14. Again, the voltage at the drain terminal of the fuel injector control MOSFET Q4 goes to zero beginning at $t_1$, when the ECU control port 12 goes low and Q4 is changed to a conducting state. At $t_2$, the ECU voltage control port 12 goes high and the supplemental control circuit 30 uses the energy stored in the capacitor to generate a virtual voltage spike 38 that is applied to the ECU injector control pin 12. Because the time interval between the initial voltage application and receipt of the virtual voltage spike 38 remains $\Delta T$, the ECU does not detect the increased duty cycle and does not generate an error signal. Subsequently, at $t_4$, which occurs after $t_2$, Q4 changes to a non-conducting state, removing the voltage from across the coil 14 and causing the reverse voltage spike labeled 36 in FIG. 5. The time interval between $t_1$ and $t_4$ is labeled $\Delta T_2$ and represents the increased length of the voltage pulse applied across the fuel injector coil. The reverse voltage spike 24 is used to charge the capacitor C2 within the supplemental control circuit 30. The invention contemplates that the first few ignition cycles are operated with a voltage pulse having a normal duration applied across the fuel injector coil to allow initial charging of the capacitor C2 in the supplemental control circuit 30.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. Thus, while the invention has been explained and illustrated for controlling a single fuel injector, it will be appreciated that it also may be practiced for the multiple fuel injectors utilized on a multi-cylinder engine. Additionally, while a capacitor has been shown and described as the energy storage device for generating virtual voltage spikes, other energy storage devices also may be utilized.

What is claimed is:

1. A supplemental control circuit for a fuel injector having a coil, the supplemental control circuit comprising:

an electronic switch adapted to be connected to the fuel injector coil, said electronic switch being operable to control the flow of an electric current through the fuel injector coil;

an energy storage device adapted to be connected to the fuel injector coil, an electronic switching circuit having an input port connected to said energy storage device and an output port adapted to be connected to a voltage control port on an engine control unit; and a microprocessor connected to said electronic switch and also adapted to be connected to said engine control unit voltage control port, said microprocessor responsive to a change in condition at said engine control unit voltage control port to supply a voltage having a modified pulse length to said fuel injector coil, said electronic switch responsive to a further change in condition at said engine control unit voltage control port to cause said energy storage device to supply energy stored within said energy storage device to said engine control unit voltage control port to simulate the duration of a normal fuel injector control pulse.

2. The supplemental control circuit according to claim 1 wherein said energy stored within said energy storage device is supplied when a magnetic field within said fuel injector collapses.

3. The supplemental control circuit according to claim 2 wherein the time period between the changes in the condition at said engine control unit voltage control port defines a normal fuel injector operating period and further wherein said modified pulse length supplied by said microprocessor differs in duration from said normal fuel injector operating period.

4. The supplemental control circuit according to claim 3 wherein the fuel injector is included in a vehicle engine and further wherein said modified pulse length is a function related to a modification made to said vehicle engine.

5. The supplemental control circuit according to claim 4 wherein said energy storage device is a capacitor.

6. The supplemental control circuit according to claim 5 wherein the condition that changes at the engine control unit voltage control port is a change in the voltage level present at the engine control unit voltage control port.

7. A method for operation of a fuel injector comprising the steps of:

(a) providing an electronic switch adapted to connected to a fuel injector coil, the electronic switch being operable to control the flow of an electric current through the fuel injector coil;

an energy storage device adapted to be connected to the fuel injector coil;

an electronic switching circuit having an input port connected to the energy storage device and output port adapted to be connected to a voltage control port on an engine control unit; and a microprocessor connected to the electronic switch and the engine control unit voltage control port;

(b) changing the electronic switch to a conducting state in response to a change of a condition at the engine control unit voltage control port whereby a current flows through fuel injector coil to open the fuel injector; and (c) utilizing the electronic switching circuit to supply energy stored within the energy storage device to the engine control unit voltage control port of the engine control unit upon the a further change of a condition at the engine control unit voltage control port to simulate the duration of a normal fuel injector control pulse.

8. The method according to claim 7 wherein the energy released from the fuel injector coil upon changing the electronic switch to a non-conducting state is stored within the energy storage device.

9. The supplemental control circuit according to claim 8 wherein the time period between the changes in the condition at the engine control unit voltage control port in steps (b) and (c) defines a normal fuel injector operating period and further wherein the modified pulse length supplied by said microprocessor differs in duration from the normal fuel injector operating period.

10. The supplemental control circuit according to claim 9 wherein the fuel injector is included in a vehicle engine and further wherein the modified pulse length is a function related to a modification made to the vehicle engine.

11. The supplemental control circuit according to claim 10 wherein said energy storage device is a capacitor.

* * * * *